US007348942B2

(12) United States Patent
Jo

(10) Patent No.: US 7,348,942 B2
(45) Date of Patent: Mar. 25, 2008

(54) ELECTRO-OPTICAL DEVICE, METHOD OF DRIVING ELECTRO-OPTICAL DEVICE, AND ELECTRONIC APPARATUS

(75) Inventor: Hiroaki Jo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 684 days.

(21) Appl. No.: 10/773,341

(22) Filed: Feb. 9, 2004

(65) Prior Publication Data

US 2004/0179005 A1 Sep. 16, 2004

(30) Foreign Application Priority Data

Feb. 19, 2003 (JP) ..... 2003-041769

(51) Int. Cl.
*G09G 3/30* (2006.01)

(52) U.S. Cl. ..... 345/76; 345/51; 345/54; 345/77; 345/95; 345/99; 345/100; 345/211; 345/204; 315/169.1; 315/169.3

(58) Field of Classification Search ..... 345/76–82, 345/89, 211–213, 46, 55, 57, 90, 95, 98–100, 345/51–54

See application file for complete search history.

(56) References Cited

U.S. PATENT DOCUMENTS 6,734,636 B2 * 5/2004 Sanford et al. ..... 315/169.3
6,738,034 B2 5/2004 Kaneko et al.
6,750,833 B2 * 6/2004 Kasai ..... 345/76
6,768,482 B2 * 7/2004 Asano et al. ..... 345/90
6,864,863 B2 3/2005 Kasai
6,922,182 B2 * 7/2005 Sase ..... 345/76
7,002,541 B2 2/2006 Yanagi et al.
2003/0030603 A1 2/2003 Shimoda
2003/0209989 A1 * 11/2003 Anzai et al. ..... 315/169.3

FOREIGN PATENT DOCUMENTS

CN 1348159 5/2002
EP 1 094 438 A1 4/2001
JP A-6-230745 8/1994

(Continued)

OTHER PUBLICATIONS

U.S. Appl. No. 10/670,346, filed Sep. 26, 2003, Miyazawa.

*Primary Examiner*—Richard Hjerpe
*Assistant Examiner*—Jennifer T Nguyen
(74) *Attorney, Agent, or Firm*—Oliff & Berridge, PLC

(57) ABSTRACT

To enhance the display characteristics of moving images and enhance the display quality in an electro-optical device using electro-optical elements that emit light with the brightness in accordance with a driving current, a pixel includes a driving transistor T4 for setting a driving current Ioled in accordance with data stored in a capacitor and an organic EL element OLED that emits light with the brightness in accordance with the driving current Ioled. During a period of time from the moment in which the scanning line corresponding to the pixel in which data is to be written to the moment in which the same scanning line is selected again, at least one of the electric potential of a first power supply line and the electric potential of a second power supply line is set to be variable and a forward bias and a reverse bias are alternately and repeatedly applied to the organic EL element OLED.

14 Claims, 15 Drawing Sheets

FOREIGN PATENT DOCUMENTS

| | | |
|---|---|---|
| JP | 2000-A-268957 | 9/2000 |
| JP | A 2000-347622 | 12/2000 |
| JP | 2001-A-117534 | 4/2001 |
| JP | 2002-A-91376 | 3/2002 |
| JP | A 2002-514320 | 5/2002 |
| JP | 2002-A-169510 | 6/2002 |
| JP | 2002-A-189448 | 7/2002 |
| JP | 2003-A-43995 | 2/2003 |

* cited by examiner

ELECTRO-OPTICAL DEVICE, METHOD OF DRIVING ELECTRO-OPTICAL DEVICE, AND ELECTRONIC APPARATUS

BACKGROUND OF THE INVENTION

1. Field of Invention

The present invention relates to an electro-optical device using electro-optical elements whose brightness is controlled by current, a method of driving the electro-optical device, and an electronic apparatus, and more particularly, to the impulse driving of electro-optical elements.

2. Description of Related Art

Related art methods to enhance the image quality of a hold type display include enhancement in the display characteristics of moving images. In the hold type display, images are continuously displayed during a period of one frame. Display using liquid crystal or organic electronic luminescence (EL) belongs to the hold type display. In the hold type display, data written in a capacitor in a pixel is stored until the data is written again after the lapse of one frame. Thus, the hold type display continuously emits light while the data is stored. For this reason, compared with an impulse type display (for example, a cathode ray tube (CRT)) that temporarily emits light in one frame, afterimages are viewed particularly when moving images are displayed. Therefore, the displayed moving images are not clear. In order to address the problem, a technique referred to as blinking, in which a black image is inserted at predetermined intervals in a process of displaying the moving images, has been suggested in the related art.

For example, a technology that performs blinking by providing switches in voltage lines for supplying predetermined voltages to pixels and controlling the light-emitting time of the organic EL elements using the switches is disclosed in Japanese Unexamined Patent Application Publication No. 2000-347622. Specifically, one frame is divided into a plurality of sub-frames. Data is written for every sub-frame.

The light-emitting period of time of the organic EL elements are set as some periods of time of the sub-frames. The organic EL elements are switched on only during the light-emitting periods of time. Therefore, since the predetermined voltages are supplied to the pixels via the voltage lines during the light-emitting periods of time, the organic EL elements emit light. However, during the other periods of time, the supply of voltages to the pixels is stopped. Thus, the organic EL elements do not emit light (black display). Accordingly, during one sub-field period of time, that is, during a period of time from the moment a certain scanning line is selected, to the moment the scanning line is selected again, each of luminescence and non-luminescence is performed once.

In Japanese Patent Application No. 2002-291145 that is a prior application by the applicant, a technology of applying a forward bias and a reverse bias to the organic EL elements by variably controlling the set voltages of voltage supply lines is disclosed. During the period of time from the moment a certain scanning line is selected to the moment the scanning line is selected again, each of the forward bias and the reverse bias is applied once to the organic EL elements. Therefore, it is possible to suppress the influences due to the difference in the threshold voltages of driving transistors and to reduce the number of transistors that constitute the pixel circuit.

SUMMARY OF THE INVENTION

Therefore, the present invention enhances the display characteristics of moving images and enhances the display quality in an electro-optical device using electro-optical elements that emit light with the brightness in accordance with driving current.

In order to address the above problems, a first aspect of the invention provides an electro-optical device, including: a plurality of scanning lines; a plurality of data lines; a plurality of pixels corresponding to intersections of the scanning lines and the data lines, each of the pixels having a storage device to store data, a driving element to set a driving current flowing from a first power supply line to a second power supply line, and an electro-optical element to emit light with a brightness in accordance with the set driving current; a scanning line driving circuit to select the scanning line corresponding to a pixel in which data is to be written by outputting scanning signals to the scanning lines; a data line driving circuit to output data to the data line corresponding to the pixel in which data is to be written in cooperation with the scanning line driving circuit; and a power supply line control circuit to perform impulse driving of the electro-optical element by setting the electric potential of at least one of the first power supply line and the second power supply line to be variable and alternately and repeatedly applying a forward bias and a reverse bias to the electro-optical element during a period of time from the moment in which the scanning line corresponding to the pixel in which the data is to be written is selected to the moment in which the same scanning line is selected again.

In the aspect of the first invention, the power supply line control circuit setting the electric potential of the second power supply line to be lower than the electric potential of the first power supply line when a forward bias is applied to the electro-optical element and sets the electric potential of the second power supply line to be no less than the electric potential of the first power supply line when a reverse bias is applied to the electro-optical element. Further, preferably, the power supply line control circuit sets the electric potential of the first power supply line to be higher than the electric potential of the second power supply line when a forward bias is applied to the electro-optical element and sets the electric potential of the first power supply line to be no more than the electric potential of the second power supply line when a reverse bias is applied to the electro-optical element. Moreover, the power supply line control circuit sets the electric potential of the first power supply line to a first electric potential and sets the electric potential of the second power supply line to a second electric potential lower than the first electric potential, when a forward bias is applied to the electro-optical element, and sets the electric potential of the first power supply line to a third electric potential lower than the first electric potential and sets the electric potential of the second power supply line to a fourth electric potential, no less than the third electric potential, when a reverse bias is applied to the electro-optical element.

Furthermore, in the first aspect of the invention, preferably, the power supply line control circuit provides a delayed period of time after the selection of a certain scanning line is stopped until the selection of the next scanning line starts, and performs impulse driving of the electro-optical element during each corresponding delayed period of time.

Furthermore, in the first aspect of the invention, the power supply line control circuits are provided in units of the scanning lines, and each of the power supply line control circuits performs impulse driving of the electro-optical elements of a row of pixels corresponding to the scanning line in synchronization with the selection of the scanning line corresponding to the corresponding power supply line control circuit.

Furthermore, in the first aspect of the invention, preferably, each of the pixels further includes a control element provided in the current path of the driving current. In this case, it is desirable that the luminescence of the pixel be controlled when data is written by controlling the electrical connection of the corresponding control element.

A second aspect of the invention provides an electronic apparatus equipped with the electro-optical device according to the above-mentioned first aspect of the invention.

A third aspect of the invention provides a method of driving an electro-optical device including a plurality of pixels arranged corresponding to intersections of scanning lines and data lines, a scanning line driving circuit to select the scanning line corresponding to a pixel in which data is to be written by outputting scanning signals to the scanning lines, and a data line driving circuit to output data to the data line corresponding to the pixel in which data is to be written in cooperation with the scanning line driving circuit, the method of driving the electro-optical device including: a first step of outputting data to the data line corresponding to a pixel in which data is to be written and of writing data in the pixel in which data is to be written; and a second step of setting a driving current flowing from a first power supply line to a second power supply line in accordance with data written in the pixel and of supplying the driving current to a current-driving-type electro-optical element emitting light with the brightness in accordance with the driving current; and a third step of performing impulse driving of the electro-optical element. In the third step, the electric potential of at least one of the first power supply line and the second power supply line is set to be variable and a forward bias and a reverse bias is alternately and repeatedly applied to the electro-optical element during a period of time from the moment in which the scanning line corresponding to the pixel is selected to the moment in which the same scanning line is selected again.

The third step of the third aspect of the invention may include: setting the electric potential of the second power supply line to be lower than the electric potential of the first power supply line when a forward bias is applied to the electro-optical element; and setting the electric potential of the second power supply line to be no less than the electric potential of the first power supply line when a reverse bias is applied to the electro-optical element. Further, the third step may include: setting the electric potential of the first power supply line to be higher than the electric potential of the second power supply line when a forward bias is applied to the electro-optical element; and setting the electric potential of the first power supply line to be no more than the electric potential of the second power supply line when a forward bias is applied to the electro-optical element. Moreover, the third step may include: setting the electric potential of the first power supply line to a first electric potential and of setting the electric potential of the second power supply line to a second electric potential lower than the first electric potential when a forward bias is applied to the electro-optical element; and setting the electric potential of the first power supply line to a third electric potential lower than the first electric potential and of setting the electric potential of the second power supply line to a fourth electric potential no less than the third electric potential when a reverse bias is applied to the electro-optical element.

Further, in the third step, a delayed period of time may be provided after the selection of a certain scanning line is stopped until the selection of the next scanning line starts, and impulse driving of the electro-optical element may be performed during each corresponding delayed period of time.

Further, in the third step, impulse driving of the electro-optical elements of the row of pixels corresponding to the scanning line may be performed in units of the scanning lines in synchronization with the selection of the scanning line.

DETAILED DESCRIPTION OF EXEMPLARY EMBODIMENTS

First Exemplary Embodiment

Figure 1:
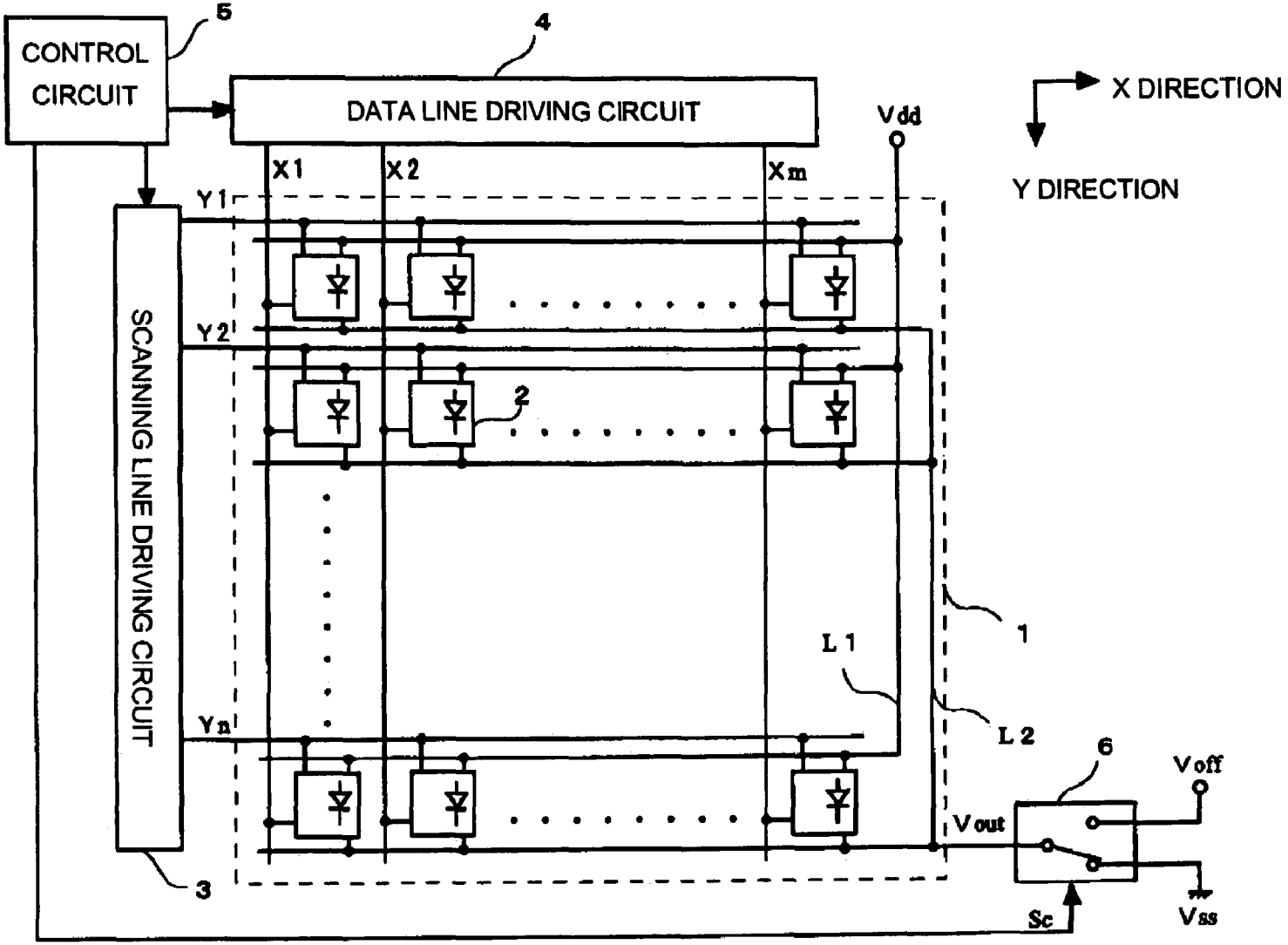
FIG. 1 is a block schematic of an electro-optical device according to a first exemplary embodiment.

FIG. 1 is a block schematic of an electro-optical device according to the present exemplary embodiment. A display unit 1 is an active matrix display panel for driving electro-optical elements by switching elements, such as field effect transistors (FET). In the display unit 1, pixels 2 of m dots x n lines are arranged in a matrix (two dimensionally). Further, a group of scanning lines Y1 to Yn that extend horizontally and a group of data lines X1 to Xm that extend vertically are provided in the display unit 1. The pixels 2 are arranged so as to correspond to the intersections of the group of scanning lines Y1 to Yn and the group of data lines X1 to Xm. The pixels 2 are commonly connected to a first power supply line L1 and a second power supply line L2. The electric potential of the first power supply line L1 is fixed to a power supply electric potential Vdd. On the other hand, the electric potential (the later-mentioned output potential Vout) of the second power supply line L2 is set to be variable in order to realize the impulse driving of the electro-optical elements. Moreover, in the present exemplary embodiment, one pixel 2 is the minimum display unit of an image. However, one pixel 2 may be constituted of a plurality of sub-pixels.

A control circuit 5 synchronously controls a scanning line driving circuit 3, a data line driving circuit 4, and a power supply line control circuit 6 based on a vertical synchronizing signal Vs, a horizontal synchronizing signal Hs, a dot clock signal DCLK, and gray scale data D. The scanning line driving circuit 3, the data line driving circuit 4, and the power supply line control circuit 6 control the display of the display unit 1 under the synchronous control in cooperation with each other. The control signal and the pulse signal output by the control circuit 5 are basically the same as in the related art. However, in the present exemplary embodiment, it should particularly be noted that a control signal Sc to control the power supply line control circuit 6 is added.

The scanning line driving circuit 3 includes a shift register and an output circuit, and selects the scanning lines Y1 to Yn in a predetermined order by outputting a scanning signal SEL to each of the scanning lines Y1 to Yn. The scanning signal SEL has a binary signal level, such as a high level (hereinafter, "H level") and a low level (hereinafter, "L level"). The scanning lines Y, corresponding to a pixel row in which data is to be written, are set to the H level. The other scanning lines Y are set to the L level. Therefore, line sequential scanning in which a group of pixels (a row of pixels) of one scanning line are selected in a predetermined selection order (generally, from the top to the bottom) is performed during one vertical scanning period of time.

The data line driving circuit 4 includes a shift register, a line latch circuit, and an output circuit. When a current program method is used as a method of writing data, image data is output to the data lines X1 to Xm as current levels. Therefore, the data line driving circuit 4 includes a variable current source to convert data (data voltages Vdata) equivalent to the display gray scales of the pixels 2 into data currents Idata. On the contrary, when a voltage program method is used, the image data is output to the data lines X1 to Xm as the voltage levels. Thus, such a variable current source is not required. The data line driving circuit 4 simultaneously performs the output of the data (Idata or Vdata) to the row of pixels in which data is written during one horizontal scanning period of time and the point-sequential latch of data to the row of pixels in which data is written during the next horizontal scanning period of time. The m data items equivalent to the number of data lines X are sequentially latched during a certain horizontal scanning period of time. The m data items latched during the next horizontal scanning period of time are converted into the data currents Idata and are simultaneously output to the data lines X1 to Xm in a current program method. The present invention may be applied to the structure in which data is directly line-sequentially input from a frame memory (not shown) to the data line-driving circuit 4. Even in this case, since the operations of the essential elements of the present invention are the same, the description thereof will be omitted. In this case, it is not necessary to provide the shift register in the data line driving circuit 4.

Figure 2:
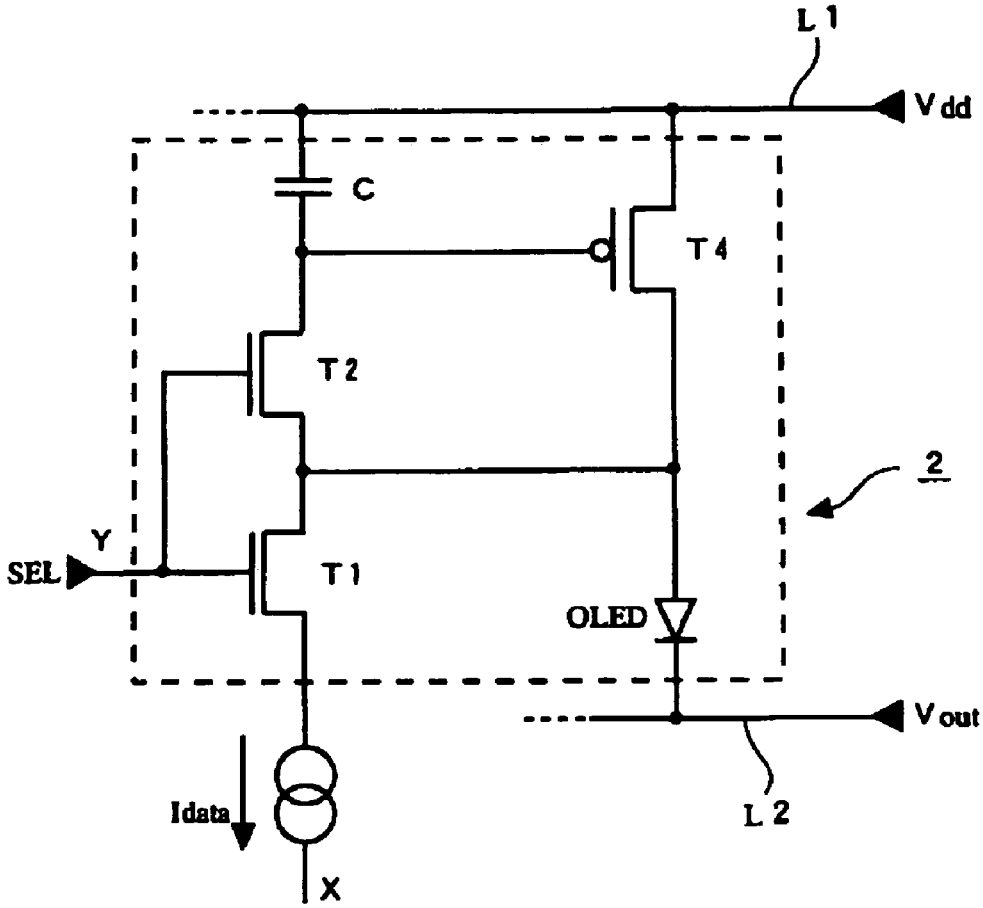
FIG. 2 is a circuit schematic of a pixel according to the first exemplary embodiment.

FIG. 2 is a circuit schematic of a pixel in a current program method, which illustrates an example of the pixel 2. One pixel 2 includes an organic EL element OLED, three transistors T1, T2, and T4, and a capacitor C to store data. In the pixel 2 illustrated in FIG. 2, the n channel transistors T1 and T2 and the p channel transistor T4 are used as an example. A memory (such as an SRAM) in which data of a large amount of bits is stored may be used as a circuit element to store the data other than the capacitor C.

The gate of the first switching transistor T1 is connected to one scanning line Y (Y denotes an arbitrary one among Y1 to Yn) to which the scanning signal SEL is supplied. The source thereof is connected to one data line X (X is an arbitrary one among X1 to Xm) to which the data current Idata is supplied. The drain of the first switching transistor T1 is commonly connected to the source of the second switching transistor T2, the drain of the driving transistor T4 that is a form of driving elements, and the anode of the organic EL element OLED. The gate of the second switching transistor T2 is connected to the scanning line Y to which the scanning signal SEL is supplied, similar to that of the first switching transistor T1. The drain of the second switching transistor T2 is commonly connected to one electrode of the capacitor C and to the gate of the driving transistor T4. The other electrode of the capacitor C and the source of the driving transistor T4 are commonly connected to a first power supply line L1 whose electric potential is set to the power supply electric potential Vdd. The cathode of the organic EL element OLED is connected to a second power supply line L2 whose electric potential is set to be variable by the output potential Vout.

Figure 3:
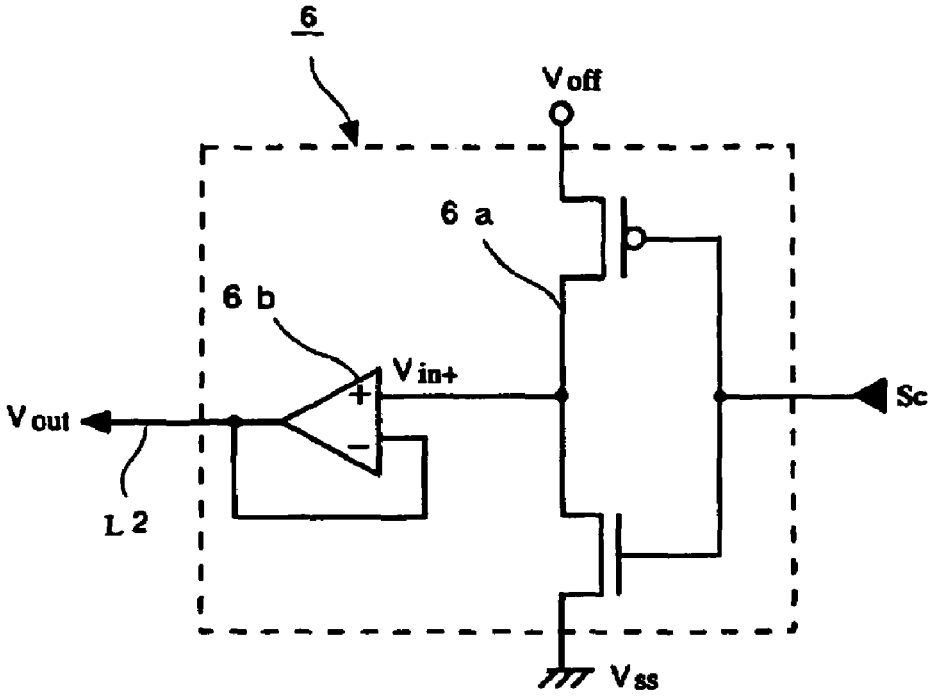
FIG. 3 is a circuit schematic of a power supply line control circuit.

The power supply line control circuit 6 variably controls the output potential Vout that is the electric potential of the second power supply line L2 in accordance with the control signal Sc from the control circuit 5. FIG. 3 is a circuit schematic of the power supply line control circuit 6. The power supply line control circuit 6 includes a CMOS inverter 6*a* and an operational amplifier 6*b* that is an amplifier. The inverter 6*a* that includes an n channel transistor and a p channel transistor serially connected between two fixed electric potentials Voff and Vss, selectively outputs the electric potentials Voff and Vss in accordance with the level of the control signal Sc that is an input thereof. The off electric potential Voff is a predetermined electric potential no less than the power supply electric potential Vdd. The electric potential Vss is a predetermined electric potential lower than the power supply electric potential Vdd ($Voff \geqq Vdd > Vss$). The output potential $Vin^+$ output from the inverter 6*a* is input to the non-inversion input port (the+ input port) of the operational amplifier 6*b*. A circuit constituted of the operational amplifier 6*b* is a buffer circuit referred to as a unity gain-buffer. A voltage follower circuit, including a source follower circuit, may be used as the circuit. The output potential Vout output from the operational amplifier 6*b* has an output waveform obtained by inverting the level of the power source control signal Sc. In order to ensure enough driving ability for circuits in a subsequent stage, the gain coefficient β of the transistor that constitutes the inverter 6*a* is set to be large and the slew rate of the operational amplifier 6*b* is set to be high.

The output potential Vout from the power supply line control circuit 6 is set to either the electric potential Vss or the electric potential Voff. Therefore, the luminescence state of the organic EL element OLED that constitutes the pixel 2 illustrated in FIG. 2 is controlled. Specifically, when the control signal Sc is at the H level, the output potential Vout output from the operational amplifier 6*b* is the electric potential Vss lower than the power supply electric potential Vdd. In this case, the electric potential Vss is applied to the cathode of the organic EL element OLED via the second power supply line L2. Since the power supply electric potential Vdd is applied to the anode of the organic EL element OLED via the first power supply line L1, a forward bias (a forward voltage) is applied to the organic EL element OLED when the electric potential Vss is applied. As a result, since a driving current Ioled may flow from the first power supply line L1 to the second power supply line L2, the organic EL element OLED is allowed to emit light. When the control signal Sc is at the L level, the output potential Vout output from the operational amplifier 6*b* is the off electric potential Voff no less than the power supply electric potential Vdd. The off electric potential Voff is applied to the cathode of the organic EL element OLED. Accordingly, the bias that is not the forward bias, that is, the reverse bias is applied to the organic EL element OLED. When the off electric potential Voff is set to the electric potential higher than the power supply electric potential Vdd, the bias that is not the forward bias is equivalent to a reverse bias (a backward voltage). When the off electric potential Voff is set to the electric-potential almost equal to the power supply electric potential Vdd (specifically, $0 \leqq Vdd-Voff<Vth$ (Vth is the threshold voltage of the organic EL element OLED)), the reverse bias is equivalent to a state in which the bias is not applied. When the reverse bias is applied, the flow of the driving current Ioled is stopped by the rectifying action of the organic EL element OLED. Therefore, the organic EL element OLED does not emit light regardless of the stored charges of the capacitor C.

Figure 4:
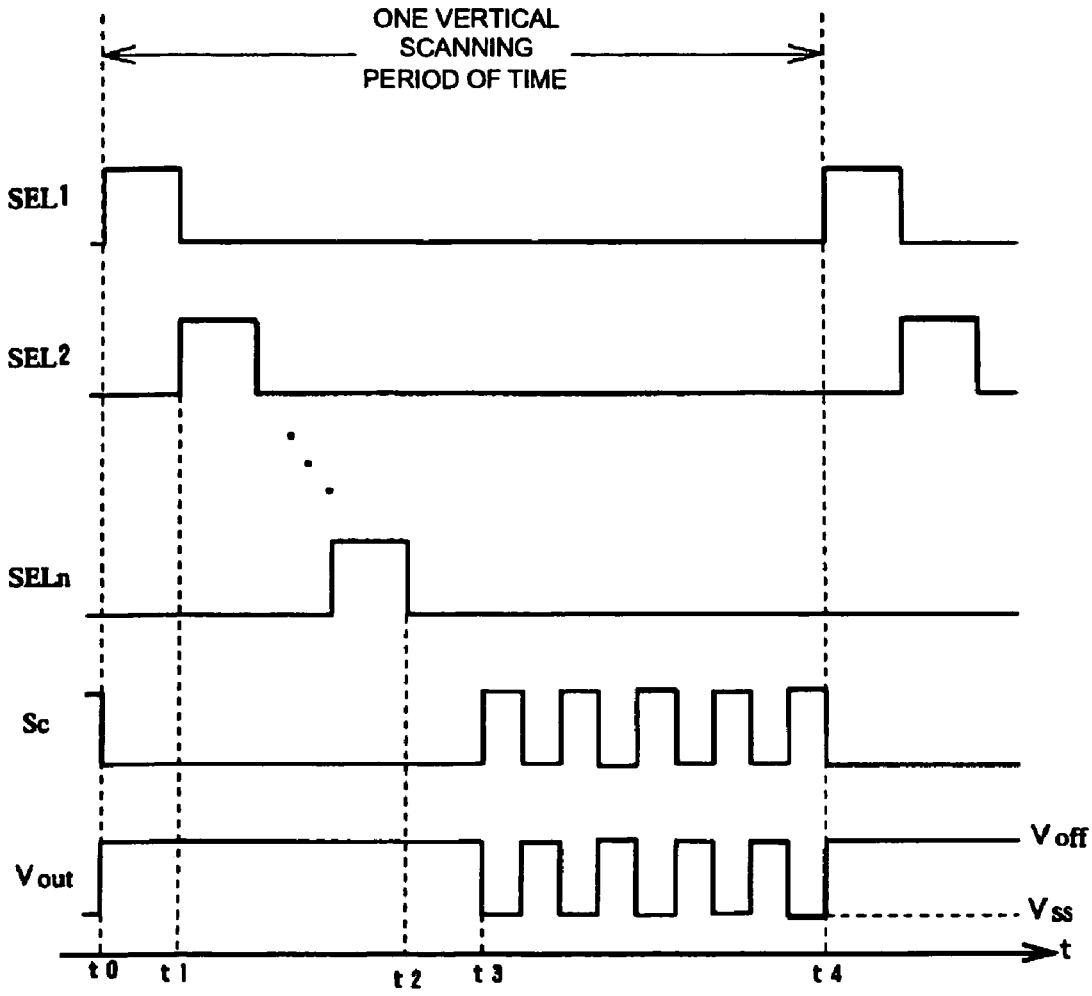
FIG. 4 is a timing chart according to the first exemplary embodiment.

FIG. 4 is a driving timing chart according to the present exemplary embodiment. First, at a timing t0, the scanning line driving circuit 3 selects the uppermost scanning line Y1 among the group of scanning lines Y1 to Yn. At the timing t0, the level of the scanning signal SEL1 of the uppermost scanning line Y1 rises up to the H level, which is maintained until timing t1. During this period of time t0 to t1, in the row of pixels corresponding to the uppermost scanning line Y1, both the switching transistors T1 and T2 illustrated in FIG. 2 are switched on. Therefore, the data line X is electrically connected to the drain of the driving transistor T4, and the gate of the driving transistor T4 is electrically connected to the drain thereof, which is a diode connection. The driving transistor T4 makes the data current Idata supplied from the data line X flow to the channel thereof and generates a gate voltage Vg in accordance with the data current Idata in the gate thereof. As a result, the charges in accordance with the generated gate voltage Vg is stored in the capacitor C connected to the gate of the driving transistor T4. Therefore, data is written in the capacitor C. At the timing t1, the scanning signal SEL1 falls to the L level. The switching transistors T1 and T2 of the row of pixels corresponding to the uppermost scanning line Y1 are switched off. Therefore, an electric connection between the data line X and the drain of the driving transistor T4 is intercepted. As a result, the writing of data in the uppermost row of pixels in which data is to be written is stopped. Since the switching transistors T1 and T2 are switched off in the row of pixels after the second row from the top, in which data is not to be written, the data is not written in the row of pixels after the second row from the top.

In synchronization with the falling of the scanning signal SEL1, the level of the scanning signal SEL2 of the next scanning line Y2 rises to the H level. The data is written in the row of pixels corresponding to the scanning line Y2 in the same process as the above-mentioned writing process. The data is line-sequentially written in the row of pixels in which the data is to be written until the timing t2 at which the selection of the lowermost scanning line Yn is stopped.

During a period of time, t0 to t3, including the period of time, t0 to t2, where the data is line-sequentially written, the level of the control signal Sc is maintained at the L level. Accordingly, the off electric potential Voff is supplied to all of the pixels 2 via the second power supply line L2 (Vout=Voff). The reverse bias is applied to the all of the organic EL elements OLED. As a result, during the period of time, t0 to t3, all of the pixels 2 are set so as not to emit light (the black display) regardless of whether a row of pixels are the ones in which the data is to be written. During the period of time, t0 to t3, the reverse bias is set in order to control the luminescence of the pixels 2 when the data is written and to secure the stability of display. Moreover, in the present exemplary embodiment, the pixels 2 do not emit light when the data is written. However, the pixels 2 may emit light in accordance with the structure of the pixel circuit (for example, the pixel circuit illustrated in FIG. 14).

At the timing t3 continuous to the timing t2, the control signal Sc that was previously at the L level changes to have a pulse waveform in which the H level and the L level are alternately repeated. When the control signal Sc is at the H level, the electric potential relationship between the first power supply line L1 and the second power supply line L2 is Vdd>Vout (=Vss). Thus, the forward bias is applied to the organic EL element OLED. Accordingly, the current path of the driving current Ioled may be formed between the driving transistor T4 and the organic EL element OLED from the first power supply line L1 to the second power supply line L2. The driving current Ioled equivalent to the channel current of the driving transistor T4 is controlled by the gate voltage Vg caused by the stored charges of the capacitor C. That is, the current level of the driving current Ioled is determined by the stored charges of the capacitor C, which are previously written. As a result, when the control signal Sc is at the H level, the organic EL element OLED emits light with the brightness in accordance with the driving current Ioled. On the other hand, when the control signal Sc is at the L level, the electric potential relationship between the first power supply line L1 and the second power supply line L2 is $Vdd \leqq Vout$ (=Voff). Thus, the reverse bias is applied to the organic EL element OLED. Therefore, in this case, since the driving current Ioled does not flow due to the rectifying action of the organic EL element OLED, the organic EL element OLED does not emit light (the black display). As mentioned above, the driving mode of the organic EL element OLED after the timing t3 is the impulse driving in which the luminescence and the non-luminescence are alternately repeated. The impulse driving continues until the end timing t4 of one vertical scanning period of time, that is, until the uppermost scanning line Y1 is selected again during the next vertical scanning period of time.

As mentioned above, in the present exemplary embodiment, during a partial period of time, t3 to t4, of the period of time, t0 to t4, from the moment the scanning line Y1 is selected to the moment the scanning line Y1 is selected again, the electric potential Vout of the second power supply line L2 is alternately set to the electric potentials Vss and Voff. Therefore, since the forward bias and the reverse bias are alternately applied to the organic EL element OLED, it is possible to make the optical response of the pixels 2 close to an impulse type response. Further, it is possible to disperse the period of time in which the black display is performed and to reduce one black display period of time by frequently switching the luminescence and the non-luminescence of the organic EL element OLED during a period of time, t3 to t4. Therefore, it is possible to reduce flickering of displayed images. As a result, it is possible to enhance the display characteristics of moving images and thus to enhance the display quality. In particular, when the off electric potential Voff is set to be higher than the power supply electric potential Vdd, the above-mentioned nonforward bias becomes a reverse bias and the forward bias and the reverse bias are alternately applied. Therefore, it is possible to prolong the lifetime of the organic EL element OLED.

Further, in the present exemplary embodiment, all of the pixels 2 are set so as not to emit light during the first half period of time, t0 to t3, of one vertical scanning period of time. All of the pixels 2 are simultaneously set to emit light during the subsequent second half period of time, t3 to t4. Accordingly, since all of the pixels 2 that constitute the display unit 1 simultaneously emit light during the same period of time, it is possible to make the brightness of the entire display unit 1 uniform without performing a complicated driving control.

Second Exemplary Embodiment

In the above-mentioned exemplary embodiment, the impulse driving is performed during the second half period of time, t3 to t4, of the one vertical scanning period of time. In the present exemplary embodiment, the period of time in which the impulse driving is performed is more uniformly dispersed during the one vertical scanning period.

Figure 5:
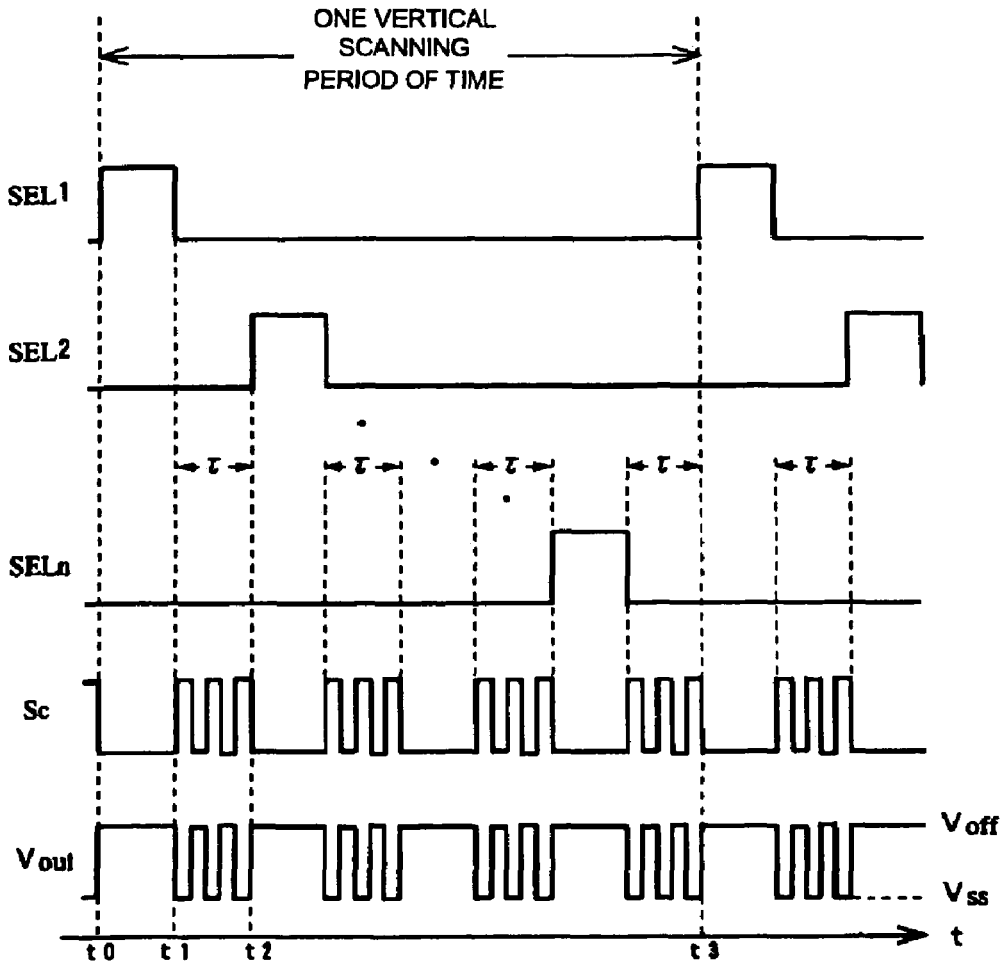
FIG. 5 is a timing chart according to a second exemplary embodiment.

FIG. 5 is a driving timing chart according to the present exemplary embodiment.

First, the scanning signal SEL1 of the uppermost scanning line Y1 is at the H level during the period of time, t0 to t1. Data is written in the row of pixels corresponding to the scanning line Y1. During the period of time, t0 to t1, the control signal Sc is maintained at the L level. Thus, the organic EL elements OLED of all of the pixels 2 are set so as not to emit light. Since the control signal Sc changes to have a pulse waveform until a predetermined delayed period of time $\tau$ passes from the timing t1, the impulse driving of all of the organic EL elements OLED is performed. During the delayed period of time $\tau$, the data is not written in any of the pixels 2. At the timing t2 where the delay time $\tau$ expires, the control signal Sc falls to the L level and all of the organic EL elements OLED stop emitting light. Further, the scanning signal SEL2 of the next scanning line Y2 rises to the H level and the data is written in the row of pixels corresponding to the scanning line Y2. The impulse driving of all of the organic EL elements OLED is performed for every delayed period of time $\tau$ until the timing t3 at which the one vertical scanning period of time stops.

In the present exemplary embodiment the delayed period of time $\tau$ is provided after the selection of a certain scanning line stops until the selection of the next scanning-line starts in the line sequential scanning. The impulse driving of all of the organic EL elements OLED is performed during each delayed period of time $\tau$. Therefore, compared with the above-mentioned exemplary embodiments, it is possible to effectively reduce the flickering of displayed images. This is because it is possible to disperse the period of time in which the impulse driving is performed during the one vertical scanning period of time and thus to divide the black display period of time in the impulse driving.

Third Exemplary Embodiment

Figure 6:
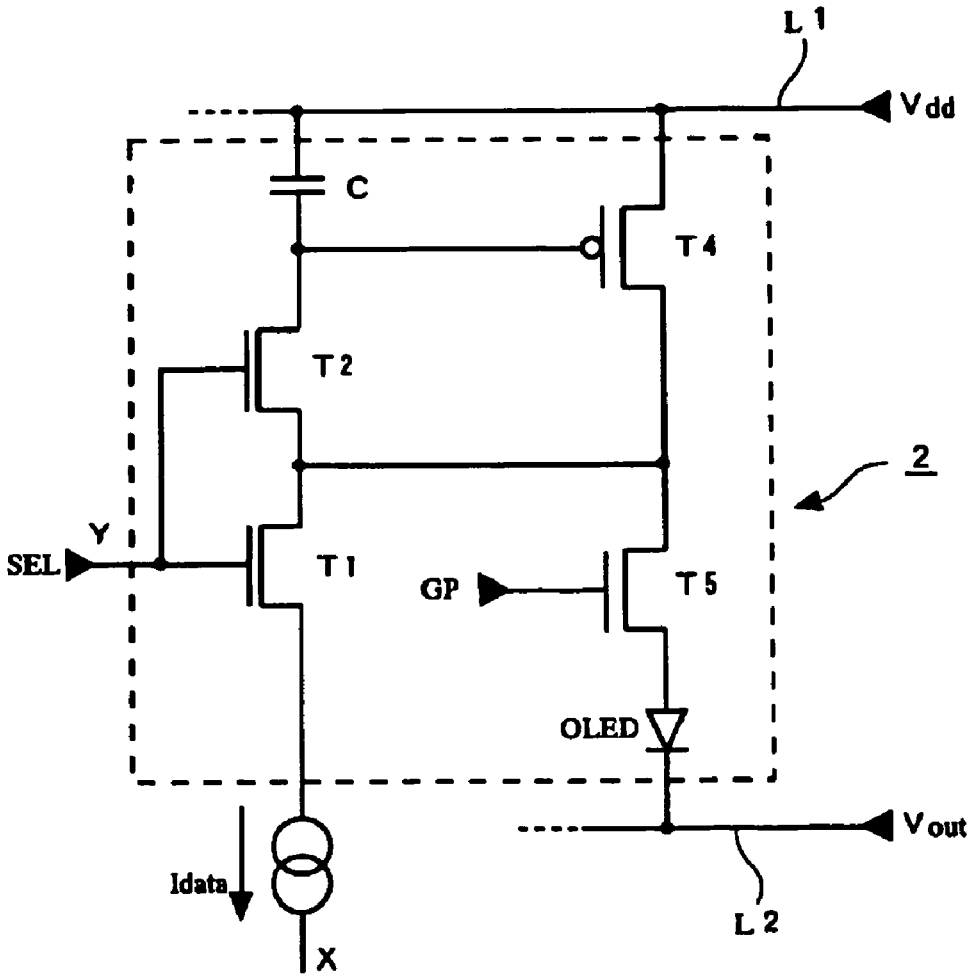
FIG. 6 is a circuit schematic of a pixel according to a third exemplary embodiment.

In the first exemplary embodiment, setting the level of the control signal Sc (Sc=L) controls the luminescence of the pixels 2 when the data is written. In the present exemplary embodiment, the luminescence is controlled by controlling the electrical connection state of the control element provided in the current path of the driving current Ioled. FIG. 6 is a circuit schematic of the pixel 2 according to the present exemplary embodiment. The structure of FIG. 6 is the same as the structure of FIG. 2 excluding that a control transistor T5 that is a form of a control element is provided in the current path of the driving current Ioled. Therefore, the same elements as the circuit elements illustrated in FIG. 2 are denoted by the same reference numerals and the detailed description thereof is omitted. The general block schematic of an electro-optical device is illustrated in FIG. 1. The control transistor T5 is, for example, an n channel transistor and is provided between the drain of the driving transistor T4 and the anode of the organic EL element OLED. Further, a control signal GP (any one among GP1 to GPn) to control the electrical connection state of the control transistor T5 in units of scanning lines is supplied to the gate of the control transistor T5. The "units of the scanning lines" include a case in which one control signal GP corresponds to each group of scanning lines in which a plurality of scanning lines Y is included, as well as a case in which the scanning lines Y correspond one-to-one to the control signals GP.

Figure 7:
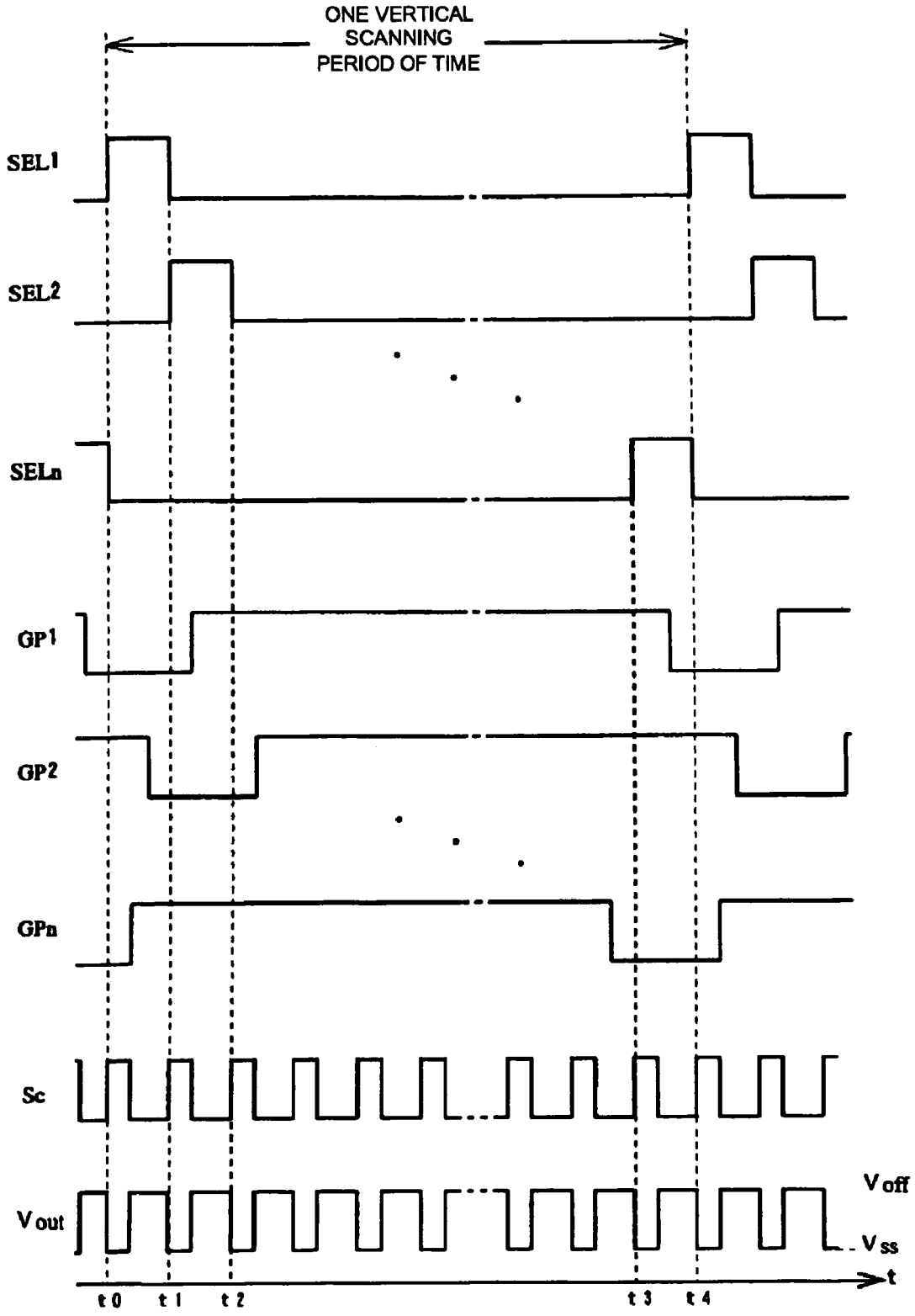
FIG. 7 is driving timing chart according to the third exemplary embodiment.

FIG. 7 is a timing chart according to the present exemplary embodiment. The main difference between the timing chart illustrated in FIG. 7 and the timing chart illustrated in FIG. 4 is that the control signals GP1 to GPn are added and that the waveform of the control signal Sc is always in a pulse (Therefore, the waveform of the output potential Vout is always in a pulse.). The control signals, GP1 to GPn, are synchronized with the corresponding scanning signals, SEL1 to SELn, and the levels thereof change by the timing offset in each row of pixels in accordance with the line sequential scanning. First, during the period of time, t0 to t1, where the scanning signal SEL1 is at the H level, the uppermost scanning line Y1 is selected and data is written in the row of pixels corresponding thereto. During the period of time, t0 to t1, the corresponding control signal GP1 is maintained at the L level. Thus, the control transistor T5 in the uppermost row of pixels is switched off. Therefore, since the current path of the driving current Ioled is intercepted, the organic EL element OLED in the uppermost row of pixels does not emit light regardless of the level of the control signal Sc. Since the control signal GP1 rises to the H level right after the timing t1 at which the selection of the scanning line Y1 is stopped, the control transistors T5 in the uppermost row of pixels are simultaneously switched on. Therefore, as in the first exemplary embodiment, the impulse driving due to the pulse shaped control signal Sc is simultaneously performed in each of the uppermost row of pixels. The impulse driving continues until the control signal GP1 falls to the L level, that is, right before the timing t4 at which the uppermost scanning line Y1 is selected next time. Subsequently, during a period of time, t1 to t2, the scanning signal SEL2 is at the H level, and data is written in the row of pixels corresponding to the scanning line Y2 right below the scanning line Y1. However, since the control signal GP2 is at the L level, the luminescence when the data is written is regulated. Since the control signal GP2 is at the H level during a period of time from right after the timing t1 at which the selection of the scanning line Y2 is stopped to right before the scanning line Y2 is selected again, the impulse driving in each of the row of pixels corresponding to the scanning line Y2 is simultaneously performed. The impulse driving is simultaneously performed in each of the row of pixels after the row of pixels corresponding to the scanning line Y2. The controlling of the luminescence when the data is written in accordance with the line sequential scanning performed by the scanning line driving circuit 3 and the impulse driving subsequent thereto are sequentially performed in the units of the scanning lines. The one vertical scanning period of time is terminated by selecting the lowermost scanning line during the period of time, t3 to t4.

According to the present exemplary embodiment, as in the above-mentioned exemplary embodiment, it is possible to enhance the display characteristics of moving-images and thus to enhance the display quality. In the present exemplary embodiment, particularly, even when the waveform of the control signal Sc is always set to be in a pulse by adding the control transistors T5, it is possible to effectively control the luminescence of the pixels 2 when the data is written. Also, it is possible to prolong the light-emitting period of time that occupies the one vertical scanning period of time compared with the first exemplary embodiment, to uniformly disperse the light-emitting period of time, and to make the organic EL element OLED with the low brightness having excellent luminescence efficiency emit light by controlling the control transistors T5 in the units of the scanning lines by the control signals GP. Moreover, it is advantageous to reducing power consumption and to prolonging the lifetime of the organic EL element OLED. The fact that the control transistors T5 are added in the current path of the driving current Ioled can be similarly applied to the following exemplary embodiments and the respective modifications of the pixel circuit.

Fourth Exemplary Embodiment

Figure 8:
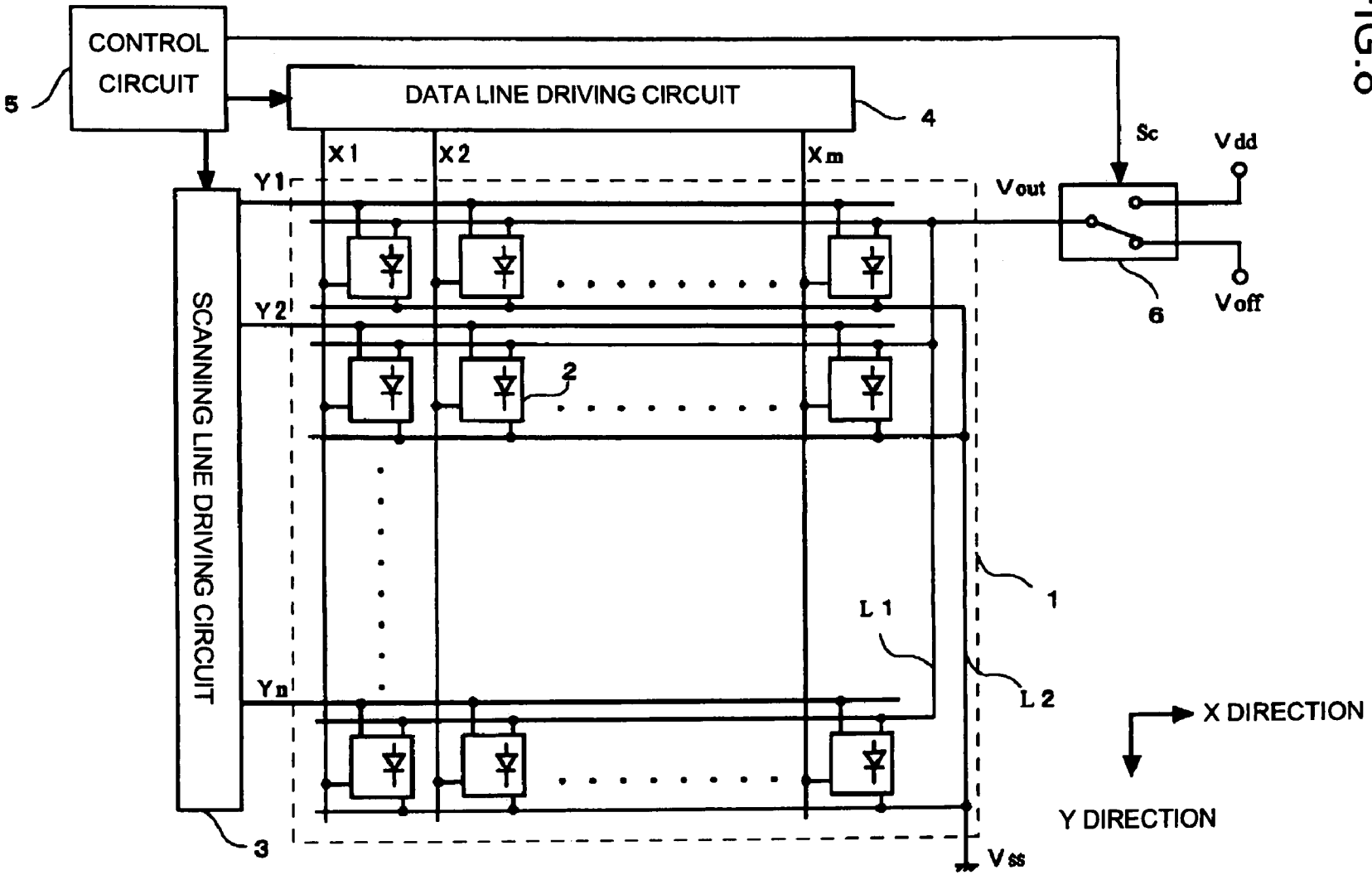
FIG. 8 is a block schematic of an electro-optical device according to a fourth exemplary embodiment.

In the present exemplary embodiment, the impulse driving is performed by fixing the electric potential of the second power supply line L2 and setting the electric potential of the first power supply line L1 to be variable. FIG. 8 is a block schematic of an electro-optical device according to the present exemplary embodiment. In order to control the output potential of the first power supply line L1, the power supply line control circuit 6 selectively outputs either the fixed electric potential Voff or the fixed electric potential Vdd as the output potential Vout in accordance with the control signal Sc from the control circuit 5. The off electric potential Voff is a predetermined electric potential no more than a predetermined electric potential Vss. The power supply electric potential Vdd is higher than the predetermined electric potential Vss (Voff≦Vss<Vdd). The circuit structure of FIG. 3 is used as the power supply line control circuit 6 as it is. However, among two electric potential terminals of the inverter 6*a* illustrated in FIG. 3, it is necessary to change the one with the off electric potential Voff to have the power supply electric potential Vdd and the other with the electric potential Vss to have the off electric potential Voff according to the present exemplary embodiment.

The luminescence of the organic EL element OLED that constitutes the pixel 2 illustrated in FIG. 2 is controlled by the output potential Vout output from the power supply line control circuit 6. When the control signal Sc is at the L level, the output potential Vout output from the power supply line control circuit 6 becomes the power supply electric potential Vdd, that is higher than the electric potential Vss. Accordingly, since a forward bias is applied to the organic EL element OLED, the organic EL element OLED is allowed to emit light. When the control signal Sc is at the H level, the output potential Vout becomes the off electric potential Voff no more than the electric potential Vss. Accordingly, since a reverse bias is applied to the organic EL element OLED, the luminescence of the organic EL element OLED is controlled by the rectifying action of the organic EL element OLED.

Figure 9:
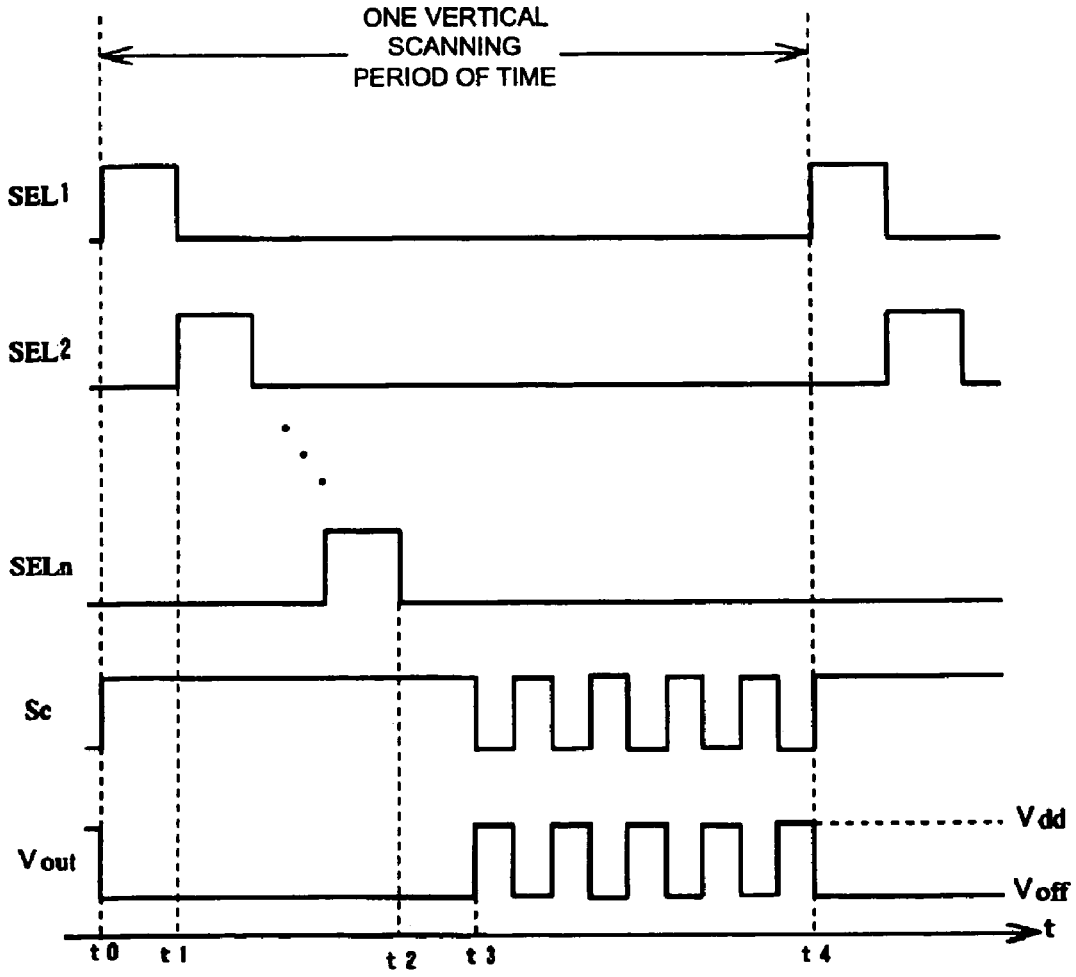
FIG. 9 is a driving timing chart of a pixel according to the fourth exemplary embodiment.

FIG. 9 is a driving timing chart according to the present exemplary embodiment. Since the power supply line whose electric potential is set to be variable is changed from the second power supply line L2 to the first power supply line L1, the control signal obtained by inverting the level of the control signal Sc of FIG. 4 is used as the control signal Sc according to the present exemplary embodiment. Since the control signal Sc is maintained at the H level during the first half period of time, t0 to t3, of the one vertical scanning period of time, t0 to t4, the off electric potential Voff is supplied to all of the pixels 2 (Vout=Voff). Accordingly, during the first half period of time, t0 to t3, the organic EL elements OLED of all of the pixels 2 are set so as not to emit light. During the subsequent second half period of time, t3 to t4, the waveform of the control signal SC is in a pulse, thereby the impulse driving of the organic EL elements OLED of all of the pixels 2 is performed.

According to the present exemplary embodiment, it is possible to perform the impulse driving by controlling the set electric potential of the first power supply line L1. Thus, as in the above-mentioned exemplary embodiment, it is possible to enhance the display characteristics of moving images and thus to enhance the display quality. In view of the driving ability of the power supply line control circuit 6, it is preferable to control the electric potential of the second power supply line L2 rather than the electric potential of the first power supply line L1. Since the driving transistor T4 is interposed in the previous stage of the organic EL element OLED when the electric potential of the first power supply line L1 is controlled, it is not possible to switch the bias applied to the organic EL element OLED in the subsequent stage if the driving transistor T4 is not charged or discharged. Since the second power supply line L2 is directly connected to the cathode of the organic EL element OLED when the electric potential of the second power supply line L2 is controlled, it is not necessary to consider the capacitance of the driving transistor T4. Therefore, it is possible to increase the speed at which the applied bias is switched. Further, in a case where the reverse bias is applied as the reverse bias when the electric potential of the first power supply line L1 is controlled, it is necessary to set the negative off electric potential Voff(Voff<Vss). Thus, an electric potential having different polarity should be generated. Since the impulse driving can be performed by only the positive electric potential, that is, by only the electric potential of the same polarity, it is advantageous to generate a voltage. The, fact that the impulse driving is performed by controlling the electric potential of the first power supply line L1 can be similarly applied to the following exemplary embodiment.

Also, it is possible to switch the applied bias by separately providing the power supply line control circuit 6 in each of the two power supply lines L1 and L2 thereby setting the electric potentials of the two power supply lines L1 and L2 to be variable. For example, in a case where the forward bias is applied to the organic EL element OLED, when the electric potential of the first power supply line L1 and the electric potential of the second power supply line L2 are respectively set to the electric potential Vdd and the electric potential Vss, and the reverse bias is applied, the electric potential of the first power supply line L1 and the electric potential of the second power supply line L2 are set to ½ Vdd. According to this technique, it is possible to reduce the amount of changes in the levels of electric potential of the power supply lines L1 and L2. Since it is possible to control a power source voltage in the range of from the electric potential Vss to the electric potential Vdd by setting the electric potentials of both of the power supply lines L1 and L2 to be variable, it is possible to simplify the structure of a power source.

Fifth Exemplary Embodiment

Figure 10:
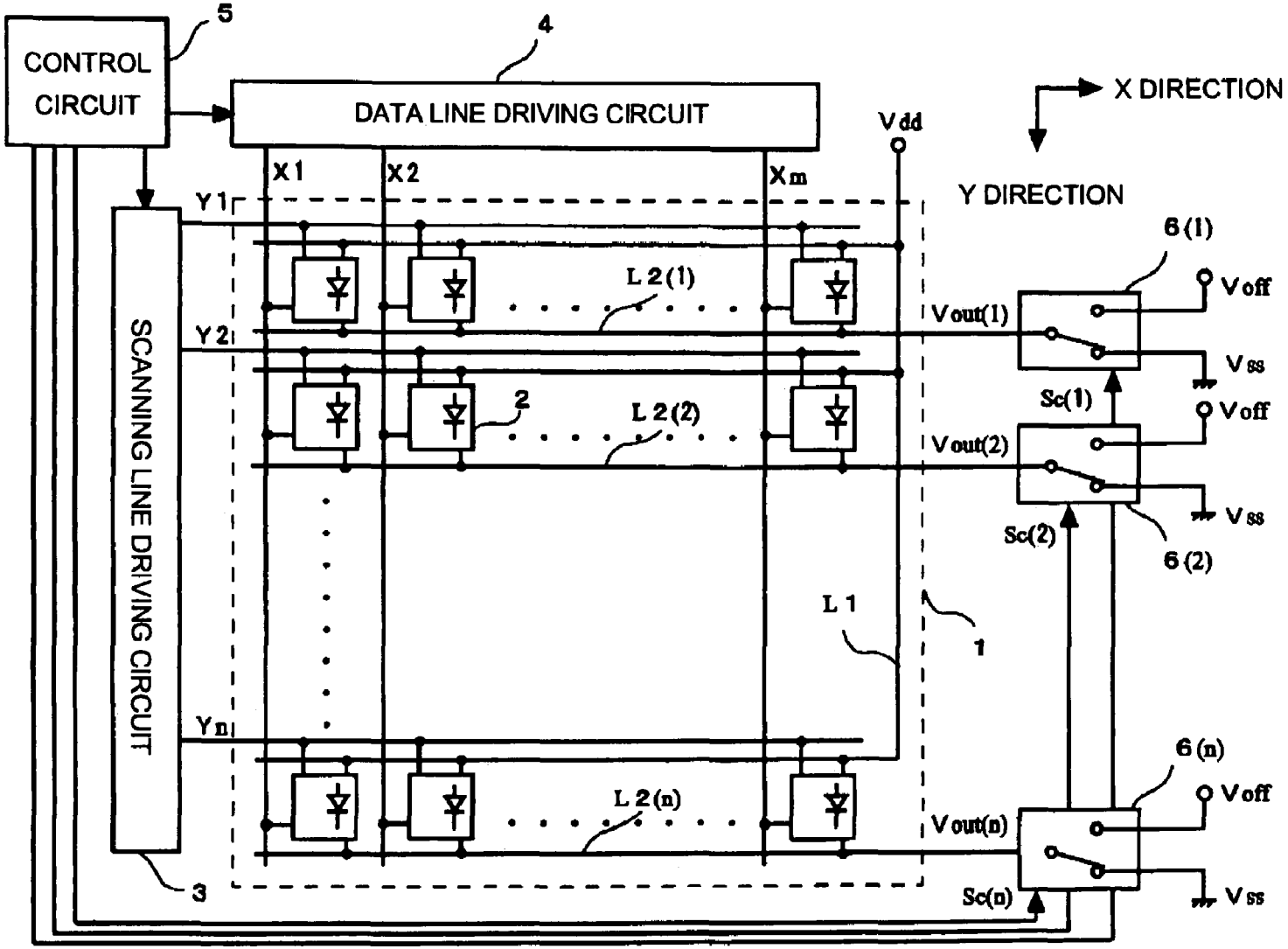
FIG. 10 is a block schematic of an electro-optical device according to a fifth exemplary embodiment.

The present exemplary embodiment relates to the driving control in which the electric potential of a power supply line is set in units of scanning lines. FIG. 10 is a block schematic of an electro-optical device according to the present exemplary embodiment. The power supply line control circuits 6(1) to 6(n) provided in the units of the scanning lines output the corresponding output potentials Vout(1) to Vout(n) in accordance with the corresponding control signals Sc(1) to Sc(n). The output potentials Vout(1) to Vout(n) are supplied to the corresponding ones among the second power supply lines L2(1) to L2(n) provided in the units of the scanning lines. For example, the power supply line control circuit 6(1) provided corresponding to the uppermost scanning line Y1 supplies the output potential Vout(1) to the second power supply line L2(1) corresponding to the row of pixels of the uppermost scanning line Y1 in accordance with the control signal Sc(1).

Figure 11:
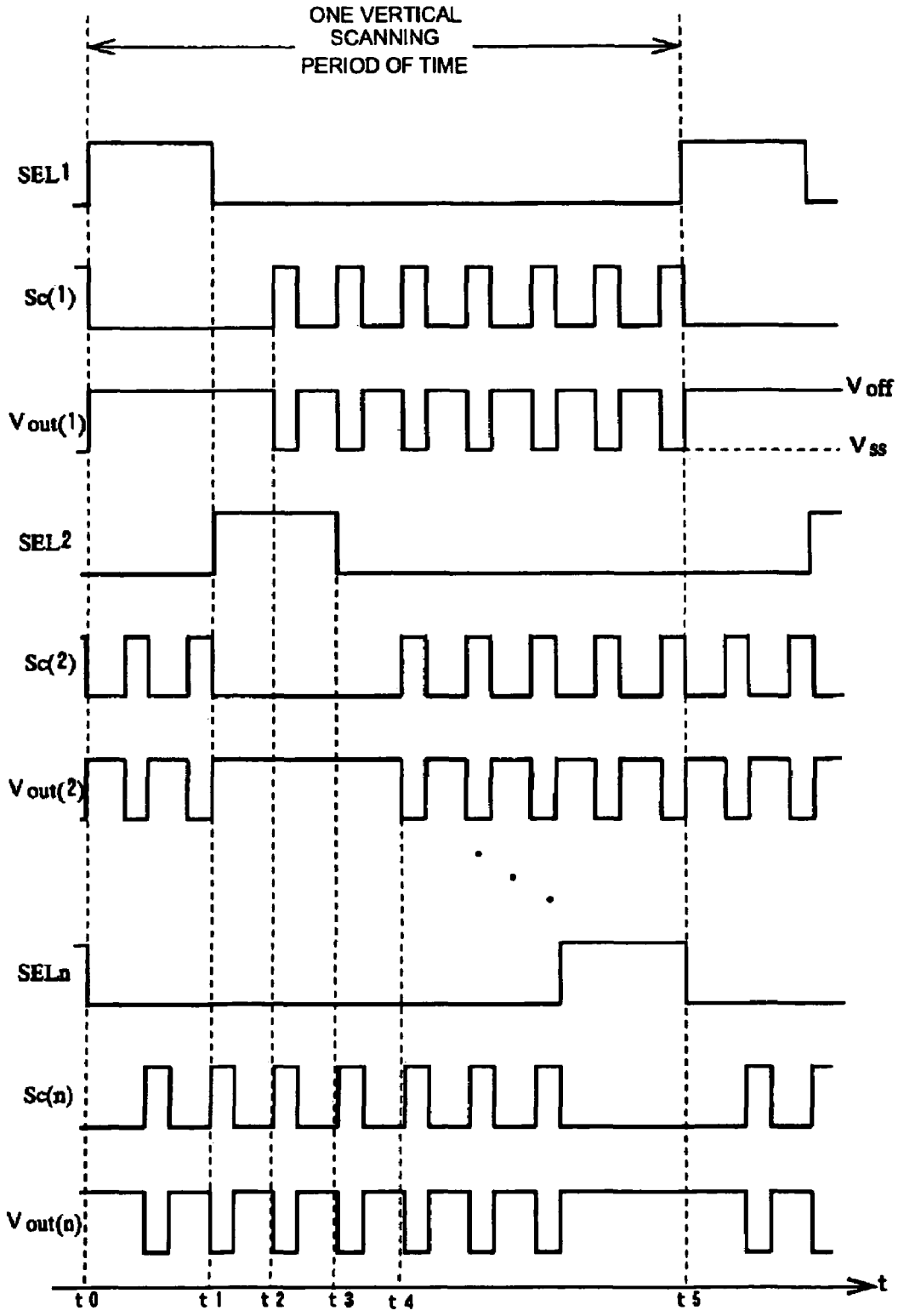
FIG. 11 is a driving timing chart of a pixel according to the fifth exemplary embodiment.

FIG. 11 is a driving timing chart according to the present exemplary embodiment. The period of time in which the impulse driving is performed is offset in each scanning line since the selection of the scanning line Y is sequentially performed. That is, according to the present exemplary embodiment, since the impulse driving is synchronized with the selection of the scanning line Y, the impulse driving is performed at the timing offset in each row of pixels. First, during a period of time, t0 to t5, (the one vertical scanning period of time) from the moment in which the row of pixels are selected to the moment in which the same row of pixels are selected again, the uppermost scanning line Y1 is selected during the first half period of time, t0 to t1, where the data is written in. During a period of time, t0 to t2, including the period of time, t0 to t1, the corresponding control signal Sc(1) is maintained at the L level and the reverse bias is applied to the organic EL elements OLED of the row of pixels. Therefore, the organic EL elements OLED are set so as not to emit light. Since the control signal Sc(1) changes to have a pulse-shaped waveform during a period of time from the timing t2 to the timing t5 at which the uppermost scanning line Y1 is selected again, the impulse driving of each of the organic EL elements OLED is simultaneously performed in the uppermost row of pixels. Next, for the row of pixels right below the scanning line Y1, the scanning line Y2 is selected during the first half period of time, t1 to t3, of the one vertical scanning period of time of the row of pixels. The data is written during the first half period of time, t1 to t3. During a period of time, t1 to t4, including the period, t1 to t3, the corresponding control signal Sc(2) is maintained at the L level and the reverse bias is applied to the organic EL elements OLED of the row of pixels. Therefore, the organic EL elements OLED are set so as not to emit light. During a period of time after the timing t4 until the timing at which the scanning line Y2 is selected again, the control signal Sc(2) changes to have a pulse-shaped waveform. Thus, the impulse driving of each of the organic EL elements OLED is simultaneously performed in the row of pixels corresponding to the scanning line Y2. The impulse driving is simultaneously performed in each of the row of pixels after the row of pixels corresponding to the scanning line Y2. While each scanning line is offset in the order of the selection of the scanning line Y by the line sequential scanning, the impulse driving is sequentially performed in the units of the scanning lines.

According to the present exemplary embodiment, the impulse driving is performed in the units of the scanning lines by providing the power supply line control circuits 6(1) to 6(n) in the units of the scanning lines and independently setting the electric potentials of the second power supply lines L2(1) to L2(n) to be variable. Therefore, it is possible to independently perform the impulse driving in the row of pixels corresponding to a certain scanning line Y without a time limit on selecting the other scanning lines Y (writing the data). As a result, since it is possible to increase the temporal ratio of the impulse driving that occupies the one vertical scanning period of time, it is possible to increase the brightness of the display unit 1 without increasing the driving current Ioled. Since changes in power consumption are suppressed, fluctuation in power source is reduced.

Moreover, the driving control according to the above-mentioned exemplary embodiments may be widely applied to various pixel circuits including the electro-optical element whose brightness is controlled by a current. The pixel circuit illustrated in FIG. 2 is only one example. The structures of pixel circuits to which the present invention may be applied will now be described as examples.

Figure 12:
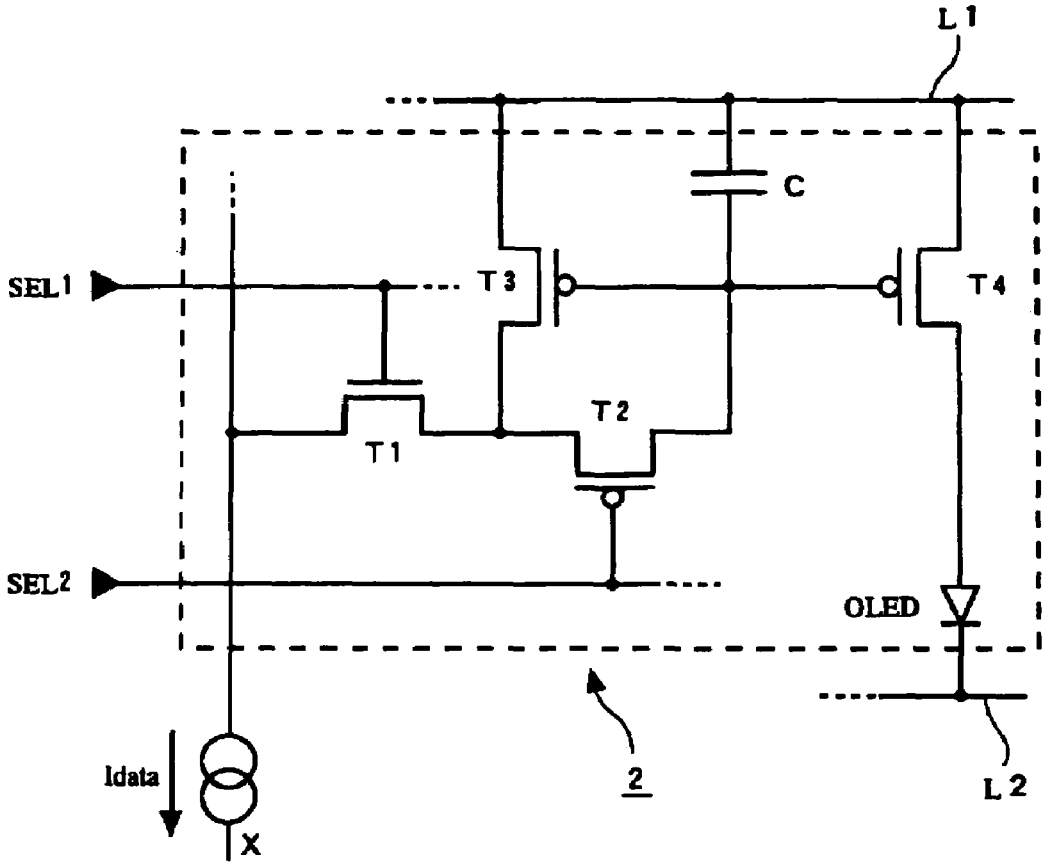
FIG. 12 is a circuit schematic illustrating a first modification of a pixel.

FIG. 12 is a circuit schematic of a pixel in a current program method, which illustrates a first modification of the pixel 2. The pixel circuit is connected to two scanning lines to which the first scanning signal SEL1 and the second scanning signal SEL2 are respectively supplied. One pixel 2 includes an organic EL element OLED, four transistors T1 to T4, and a capacitor C. In the pixel circuit, for example, the n channel transistor T1 and the channel transistors T2 to t4 are used. The gate of the first switching transistor T1 is connected to the scanning line to which the first scanning signal SEL1 is supplied. The source of the first switching transistor T1 is connected to the data line X to which the data current Idata is supplied. Further, the drain of the first switching transistor T1 is commonly connected to the drain of the second switching transistor T2 and the drain of the programming transistor T3. The source of the second switching transistor T2 to whose gate the second scanning signal SEL2 is supplied is commonly connected to the gates of the pair of transistors T3 and T4 that constitute a current mirror circuit and one electrode of the capacitor C. The source of the programming transistor T3, the source of the driving transistor T4, and the other electrode of the capacitor C are connected to the first power supply line L1. Meanwhile, the cathode of the organic EL element OLED is connected to the second power supply line L2.

A process of controlling the pixel circuit illustrated in FIG. 12 is as follows. First, in the first half of the one vertical scanning period of time, the first scanning signal SEL1 and the second scanning signal SEL2 are respectively set to be at the H level and the L level. Therefore, the programming transistor T3 makes the data current Idata supplied from the data line X flow through the channel thereof and generates the gate voltage Vg in accordance with the data current Idata in the gate thereof. Charges are stored in the capacitor C due to the gate voltage Vg, thereby writing data in the capacitor C. Then, during the second half of the one vertical scanning period of time, the first scanning signal SEL1 and the second scanning signal SEL2 are respectively set to be at the L level and the H level. Therefore, an electric connection between the gate of the programming transistor T3 and the drain of the programming transistor T3 is intercepted. A voltage equivalent to the gate voltage Vg is applied to the gate of the driving transistor T4 due to the charges stored in the capacitor C. In this state, the impulse driving of the organic EL element OLED is performed by setting at least one of the first power supply line L1 and the second power supply line L2 to be variable.

Figure 13:
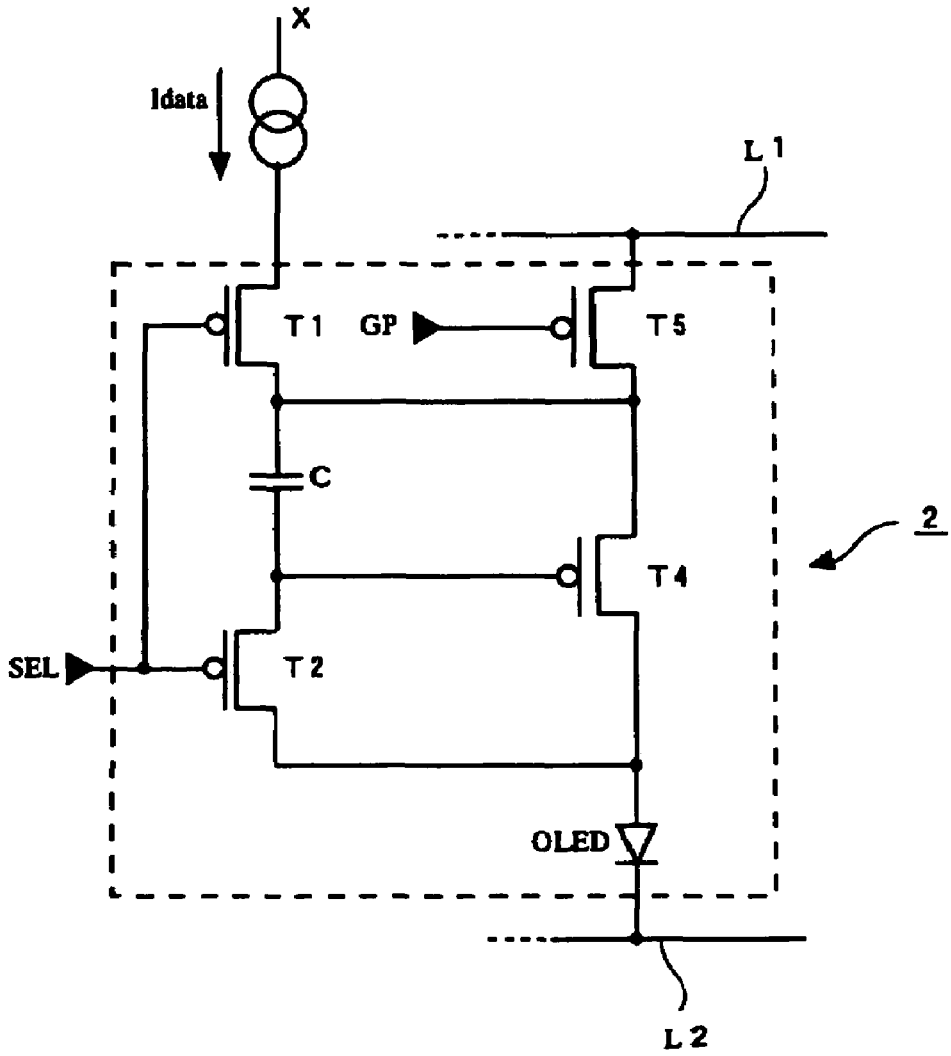
FIG. 13 is a circuit schematic illustrating a second modification of a pixel.

FIG. 13 is a circuit schematic of a pixel in a current program method, which illustrates a second modification of the pixel 2. In the pixel circuit, one scanning line, to which the scanning signal SEL is supplied, is connected to one signal line to which the control signal GP is supplied. One pixel 2 includes an organic EL element OLED, four p channel transistors T1, T2, T4, and T5, and a capacitor C. The gate of the first switching transistor T1 is connected to the scanning line to which the scanning signal SEL is supplied. The source of the first switching transistor T1 is connected to the data line X to which the data current Idata is supplied. The drain of the first switching transistor. T1 is commonly connected to the drain of the control transistor T5, the source of the driving transistor T4, and one electrode of the capacitor C. The other electrode of the capacitor C is commonly connected to the gate of the driving transistor T4 and the source of the second switching transistor T2. The gate of the second switching transistor T2 is connected to the scanning line to which the scanning signal SEL is supplied, similar to the first switching transistor T1. The drain of the second switching transistor T2 is commonly connected to the drain of the driving transistor T4 and the anode of the organic EL element OLED. The cathode of the organic EL element OLED is connected to the second power supply line L2. Meanwhile, the gate of the control transistor T5 is connected to the signal line to which the control signal GP is supplied. The source of the control transistor T5 is connected to the first power supply line L1.

A process of controlling the pixel circuit illustrated in FIG. 13 is as follows. First, during the first half of the one vertical scanning period of time, the scanning signal SEL and the control signal GP are respectively set to be at the L level and the H level. Therefore, the driving transistor T4 makes the data current Idata supplied from the data line X flow through the channel thereof and generates the gate voltage Vg in accordance with the data current Idata in the gate thereof. Charges are stored in the capacitor C due to the gate voltage Vg. The data is written in the capacitor C. During the second half of the one vertical scanning period of time, the scanning signal SEL and the control signal GP are respectively set to be at the H level and the L level. Therefore, an electric connection between the gate of the driving transistor T4 and the drain of the driving transistor T4 is intercepted. A voltage equivalent to the gate voltage Vg is applied to the gate of the driving transistor T4 in accordance with the charges stored in the capacitor C. In this state, the impulse driving of the organic EL element OLED is performed by setting at least one of the electric potential of the first power supply line L1 and the electric potential of the second power supply line L2 to be variable.

Figure 14:
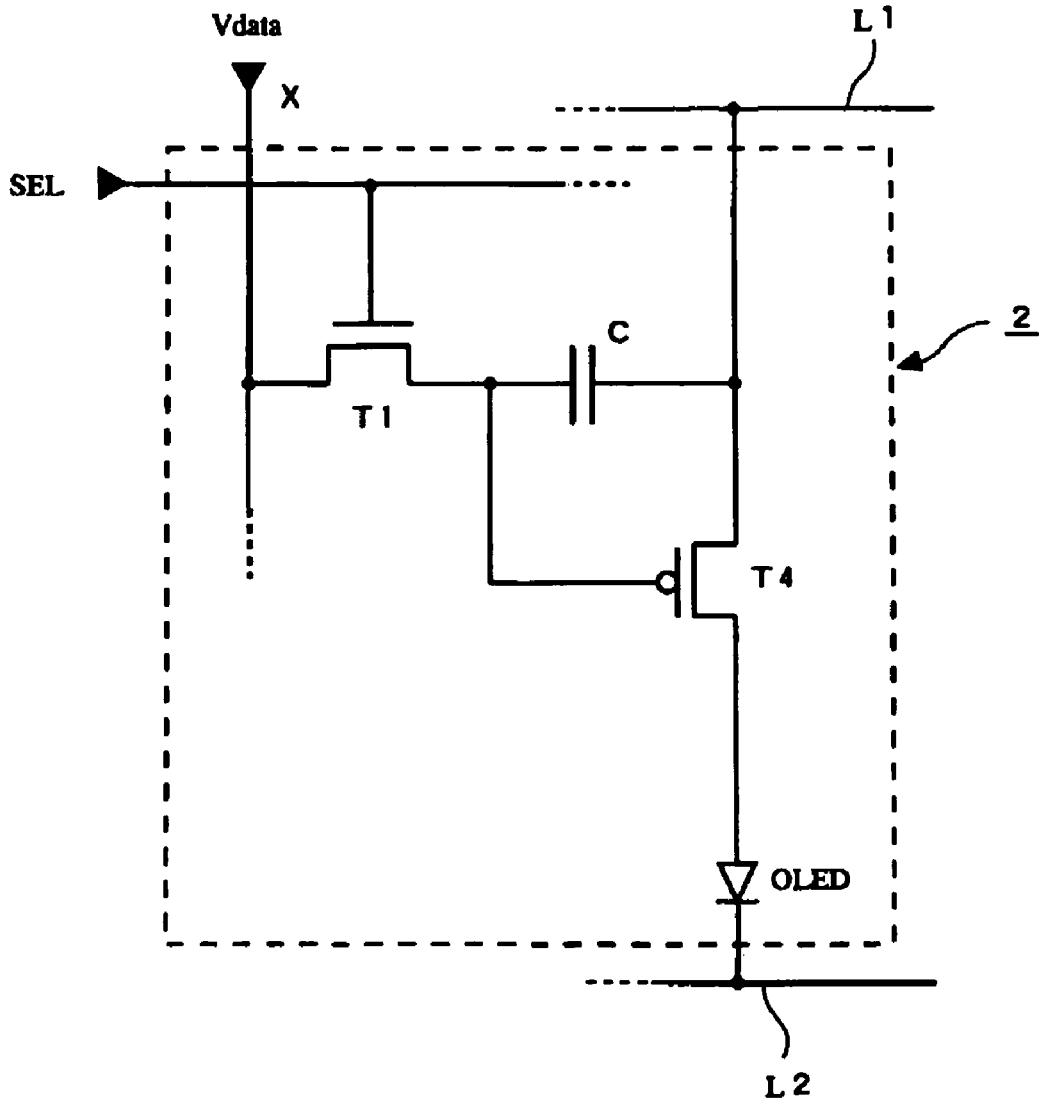
FIG. 14 is a circuit schematic illustrating a third modification of a pixel.

FIG. 14 is a circuit schematic of a pixel in a voltage program method, which illustrates a third modification of the pixel 2. The pixel circuit is connected to one scanning line to which the scanning signal SEL is supplied. One pixel 2 includes an organic EL element OLED, an n channel transistor T1, a p channel transistor T4, and a capacitor C. The gate of the switching transistor T1 is connected to the scanning line to which the scanning signal SEL is supplied. The drain of the switching transistor T1 is connected to the data line X to which the data voltage Vdata is supplied. The source of the switching transistor t1 is commonly connected to one electrode of the capacitor C and the gate of the driving transistor T4. The other electrode of the capacitor C is commonly connected to the source of the driving transistor T4 and the first power supply line L1. The drain of the driving transistor T4 is connected to the anode of the organic EL element OLED. The cathode of the organic EL element OLED is connected to the second power supply line L2.

A process of controlling the pixel circuit illustrated in FIG. 14 is as follows. The data voltage Vdata supplied to the data line X during a period of time where the scanning signal SEL is at the H level is applied to one electrode of the capacitor C. Therefore, charges corresponding to the data voltage Vdata is stored in the capacitor C. A voltage corresponding to the gate voltage Vg is applied to the gate of the driving transistor T4 due to the charges stored in the capacitor C. In this state, the impulse driving of the organic EL element OLED is performed by setting at least one of the first power supply line L1 and the second power supply line L2 to be variable.

Figure 15:
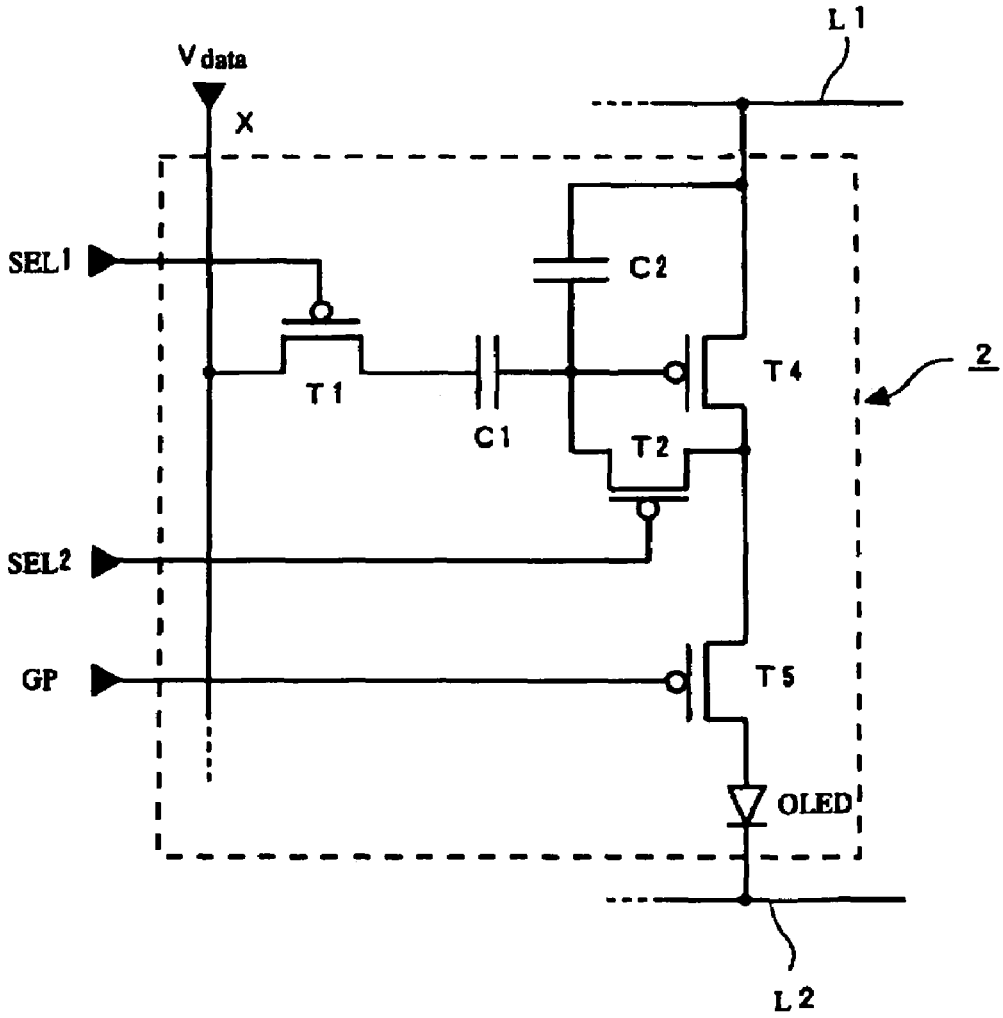
FIG. 15 is a circuit schematic illustrating a fourth modification of a pixel.

FIG. 15 is a circuit schematic of a pixel in a voltage program method, which illustrates a fourth modification of the pixel 2. The pixel circuit is connected two scanning lines to which the first scanning signal SEL1 and the second scanning signal SEL2 are supplied and a signal line to which the control signal GP is supplied. One pixel 2 includes an organic EL element OLED, four p channel transistors T1, T2, T4, and T5, and two capacitors C1 and C2. The gate of the first switching transistor T1 is connected to the scanning line to which the first scanning signal SEL1 is supplied. The source of the first switching transistor T1 is connected to the data line X to which the data voltage Vdata is supplied. The drain of the first switching transistor T1 is connected to one electrode of the first capacitor C1. Further, the other electrode of the first capacitor C1 is commonly connected to one electrode of the second capacitor C2, the source of the second switching transistor T2, and the gate of the driving transistor T4. The other electrode of the second capacitor C2 and the source of the driving transistor T4 are connected to the first power supply line L1. The second scanning signal SEL2 is supplied to the gate of the second switching transistor T2. The drain of the second switching transistor T2 is commonly connected to the drain of the driving transistor T4 and the source of the control transistor T5. The control transistor T5, to whose gate the control signal GP is supplied, is provided between the drain of the driving transistor T4 and the anode of the organic EL element OLED. The cathode of the organic EL element OLED is connected to the second power supply line L2.

A process of controlling the pixel circuit illustrated in FIG. 15 is as follows. The one vertical scanning period of time can be divided into four periods of time. First, during a first period of time, the control transistor T5 is switched on by the control signal GP at the L level and the electric potential of the drain of the driving transistor T4 is set to the electric potential Vss. Next, a power supply electric potential Vdd applied to the source of the driving transistor T4 is applied to the gate of the driving transistor T4 via a channel of the driving transistor T4 and the second switching transistor T2 by the second scanning signal SEL2 at the L level and the control signal GP at the H level during a second period of time. Therefore, a voltage Vgs of the gate of the driving transistor T4 is forced to increase to the threshold voltage Vth of the driving transistor T4. The threshold voltage Vth is applied to each of the electrodes of the two capacitors C1 and C2 connected to the gate of the driving transistor T4. Since the power supply electric potential Vdd is supplied to the other electrodes of the capacitors C1 and C2, a difference between the electric potentials of the capacitors C1 and C2 is set to a difference (Vdd−Vth)

between the power supply electric potential Vdd and the threshold voltage Vth. During a third period of time, a voltage whose level is reduced from the level of the power supply electric potential Vdd by the level of the data voltage Vdata is applied to the data line X as the data voltage Vdata and data is written in the capacitors C1 and C2. In this state, at least one of the electric potential of the first power supply line L1 and the electric potential of the second power supply line L2 is set to be variable, thereby performing the impulse driving of the organic EL element OLED. Moreover, a basic process of controlling the pixel circuit illustrated in FIG. 15 is described in PCT Japanese Translation Patent Publication No. 2002-514320.

In the above-mentioned respective exemplary embodiments, in cases where the organic EL elements OLED do not emit light since the impulse driving thereof is performed, it is not necessary that the relationship of VL1≦VL2 be established between the electric potential VL1 of the first power supply line L1 and the electric potential VL2, of the second power supply line L2. Strictly speaking, for the entire circuit, in consideration of a voltage VEL in which the organic EL element OLED starts to emit light, the relationship of VL1+VEL≦VL2 is preferably established among the electric potential VL1 of the first power supply line L1, the electric potential VL2 of the second power supply line L2, and the voltage VEL. Here, the voltage VEL is obtained by adding the threshold voltage of each transistor to the luminescence threshold voltage of the organic EL element OLED.

Further, in the above-mentioned exemplary embodiments, examples of using the organic EL elements OLED as electro-optical elements are described. However, the present invention is not limited thereto and may be applied to other electro-optical elements that emit light with the brightness in accordance with the driving current.

Furthermore, the electro-optical devices according to the respective exemplary embodiments can be mounted in various electronic apparatuses including television sets, projectors, mobile telephones, portable terminals, mobile computers, and personal computers. When the above-mentioned electro-optical devices are mounted on the electronic apparatuses, it is possible to further enhance the qualities of the electronic apparatuses and thus to attract consumers in markets.

According to an aspect of the present invention, at least one of the electric potential of the first power supply line and the electric potential of the second power supply line is set to be variable and the forward bias and the reverse bias are alternately applied to the electro-optical element during a period of time from the moment in which a certain scanning line is selected to the moment in which the scanning line is selected again. Therefore, it is possible to enhance the display characteristics of moving images and thus to enhance the display quality.

What is claimed is:

1. An electro-optical device, comprising:

a plurality of scanning lines;

a plurality of data lines;

a plurality of pixels corresponding to intersections of the scanning lines and the data lines, each of the pixels having a storage device to store data, a driving element to set a driving current flowing from a first power supply line to a second power supply line, and an electro-optical element to emit light with a brightness in accordance with the set driving current;

a scanning line driving circuit to select the scanning line corresponding to a pixel in which data is to be written by outputting scanning signals to the scanning lines;

a data line driving circuit to output data to the data line corresponding to the pixel in which data is to be written in cooperation with the scanning line driving circuit; and a power supply line control circuit to perform impulse driving of the electro-optical element more than once by setting the electric potential of at least one of the first power supply line and the second power supply line to be variable and alternately and repeatedly applying a forward bias and a reverse bias to the electro-optical element during a period of time from the moment in which the scanning line corresponding to the pixel in which the data is to be written is selected, to the moment in which the same scanning line is selected again.

2. The electro-optical device according to claim 1, the power supply line control circuit setting the electric potential of the second power supply line to be lower than the electric potential of the first power supply line when a forward bias is applied to the electro-optical element and setting the electric potential of the second power supply line to be no less than the electric potential of the first power supply line when a reverse bias is applied to the electro-optical element.

3. The electro-optical device according to claim 1, the power supply line control circuit setting the electric potential of the first power supply line to be higher than the electric potential of the second power supply line when a forward bias is applied to the electro-optical element and setting the electric potential of the first power supply line to be no more than the electric potential of the second power supply line when a reverse bias is applied to the electro-optical element.

4. The electro-optical device according to claim 1, the power supply line control circuit setting the electric potential of the first power supply line to a first electric potential and setting the electric potential of the second power supply line to a second electric potential lower than the first electric potential when a forward bias is applied to the electro-optical element, and setting the electric potential of the first power supply line to a third electric potential lower than the first electric potential and setting the electric potential of the second power supply line to a fourth electric potential no less than the third electric potential when a reverse bias is applied to the electro-optical element.

5. The electro-optical device according to claim 1, the power supply line control circuit providing a delayed period of time after the selection of a certain scanning line is stopped until the selection of the next scanning line starts, and performing impulse driving of the electro-optical element during each corresponding delayed period of time.

6. The electro-optical device according to claim 1, the power supply line control circuits being provided in units of the scanning lines, and each of the power supply line control circuits performing impulse driving of the electro-optical elements of a row of pixels corresponding to the scanning line in synchronization with the selection of the scanning line corresponding to the corresponding power supply line control circuit.

7. The electro-optical device according to claim 1, each of the pixels further comprises:

a control element provided in the current path of the driving current and the luminescence of the pixel being controlled when data is written by controlling the electrical connection of the corresponding control element.

8. An electronic apparatus equipped with the electro-optical device according to claim 1.

9. A method of driving an electro-optical device including a plurality of pixels arranged corresponding to intersections of scanning lines and data lines, a scanning line driving circuit for selecting the scanning line corresponding to a pixel in which data is to be written by outputting scanning signals to the scanning lines, and a data line driving circuit for outputting data to the data line corresponding to the pixel in which data is to be written in cooperation with the scanning line driving circuit, the method of driving the electro-optical device comprising:

outputting data to the data line corresponding to a pixel in which data is to be written and writing data in the pixel in which data is to be written; and setting a driving current flowing from a first power supply line to a second power supply line in accordance with data written in the pixel and supplying the driving current to a current-driving-type electro-optical element emitting light with the brightness in accordance with the driving current; and performing impulse driving of the electro-optical element more than once by setting the electric potential of at least one of the first power supply line and the second power supply line to be variable and alternately and repeatedly applying a forward bias and a reverse bias to the electro-optical element during a period of time from the moment in which the scanning line corresponding to the pixel is selected to the moment in which the same scanning line is selected again.

10. The method of driving the electro-optical device according to claim 9, the third step comprises:

setting the electric potential of the second power supply line to be lower than the electric potential of the first power supply line when a forward bias is applied to the electro-optical element; and setting the electric potential of the second power supply line to be no less than the electric potential of the first power supply line when a reverse bias is applied to the electro-optical element.

11. The method of driving the electro-optical device according to claim 9, the third step comprises:

setting the electric potential of the first power supply line to be higher than the electric potential of the second power supply line when a forward bias is applied to the electro-optical element; and setting the electric potential of the first power supply line to be no more than the electric potential of the second power supply line when a reverse bias is applied to the electro-optical element.

12. The method of driving the electro-optical device according to claim 9, the third step comprises:

setting the electric potential of the first power supply line to a first electric potential and setting the electric potential of the second power supply line to a second electric potential lower than the first electric potential when a forward bias is applied to the electro-optical element; and setting the electric potential of the first power supply line to a third electric potential lower than the first electric potential and of-setting the electric potential of the second power supply line to a fourth electric potential no less than the third electric potential when a reverse bias is applied to the electro-optical element.

13. The method of driving the electro-optical device according to claim 9, in the third step, a delayed period of time is provided after the selection of a certain scanning line is stopped until the selection of the next scanning line starts, and impulse driving of the electro-optical element is performed during each corresponding delayed period of time.

14. The method of driving the electro-optical device according to claim 9, in the third step, impulse driving of the electro-optical elements of the row of pixels corresponding to the scanning line is performed in units of the scanning lines in synchronization with the selection of the scanning line.

* * * * *